US010836182B2

(12) United States Patent
Gilan et al.

(10) Patent No.: US 10,836,182 B2
(45) Date of Patent: Nov. 17, 2020

(54) CALIBRATION OF A SENSOR

(71) Applicant: HP Indigo B.V., Amstelveen (NL)

(72) Inventors: Ziv Gilan, Ness Ziona (IL); Zvi Shemer, Ness Ziona (IL); Shai Atad, Ness Ziona (IL); Shlomo Haik, Ness Ziona (IL); Yehuda Roth, Ness Ziona (IL); Pavel Sandik, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/344,418

(22) PCT Filed: Oct. 31, 2016

(86) PCT No.: PCT/EP2016/076241
§ 371 (c)(1),
(2) Date: Apr. 24, 2019

(87) PCT Pub. No.: WO2018/077445
PCT Pub. Date: May 3, 2018

(65) Prior Publication Data

US 2020/0047515 A1 Feb. 13, 2020

(51) Int. Cl.

| | |
|---|---|
| ***B41J 2/21*** | (2006.01) |
| ***B41J 2/125*** | (2006.01) |
| ***B65H 43/08*** | (2006.01) |

(52) U.S. Cl.
CPC ..... *B41J 2/2132* (2013.01); *B41J 2/125* (2013.01); *B65H 43/08* (2013.01); *B65H 2557/61* (2013.01)

(58) Field of Classification Search
CPC . B41J 2/195; B41J 29/393; B41J 2/125; B41J 2/2132; G03G 15/105; B65H 2557/61; B65H 43/08
See application file for complete search history.

(56) References Cited

U.S. PATENT DOCUMENTS

| | | | |
|---|---|---|---|
| 5,537,516 | A | 7/1996 | Sherman et al. |
| 7,262,882 | B2 | 8/2007 | Hagai et al. |
| 8,009,332 | B2 | 8/2011 | He et al. |
| 8,100,057 | B2 | 1/2012 | Hartmann et al. |
| 8,767,277 | B2 | 7/2014 | Uroz Soria et al. |
| 9,373,063 | B2 | 6/2016 | Derhak et al. |

(Continued)

FOREIGN PATENT DOCUMENTS

| | | |
|---|---|---|
| EP | 2719157 | 12/2012 |

OTHER PUBLICATIONS

Emmel, P. et al, Colour Calibration for Colour Reproduction. 2000, < http://ieeexplore.ieee.org/xpls/abs_all.jsp?arnumber=857374 &tag=1 >.

*Primary Examiner* — Jannelle M Lebron
(74) *Attorney, Agent, or Firm* — Middleton Reutlinger

(57) ABSTRACT

In one example of the disclosure, an uncalibrated sensor may be calibrated. Calibrated sensor data is obtained. The data relates to an amount of light transmitted through an ink solution of a first colour as a function of ink concentration. An amount of light transmitted through an ink solution of the first colour is measured, using the uncalibrated sensor, at a plurality of ink concentrations. A calibration factor relating the light transmission of the calibrated sensor for the first colour and the light transmission of the uncalibrated sensor for the first colour is determined, using a processor, based on the obtained data and the measurements.

14 Claims, 6 Drawing Sheets

(56) References Cited

U.S. PATENT DOCUMENTS

| | | | |
|---|---|---|---|
| 2005/0116970 | A1 | 6/2005 | Nakazawa |
| 2007/0252861 | A1 | 11/2007 | Wu et al. |
| 2012/0320378 | A1 | 12/2012 | Shemer et al. |

CALIBRATION OF A SENSOR

BACKGROUND

In some printing systems, print agent may be dissolved into a solvent to form a print solution which may be used as ink in the printing system to be printed onto a substrate (such as a sheet paper). The proportion of print agent in the print solution may be monitored using a sensor.

Sensors used in printing systems may measure parameters slightly differently from one another due to small mechanical differences in the sensors themselves, which may be caused by the manner in which they are manufactured. In some examples, therefore, sensors may be calibrated to achieve consistent and/or accurate measurements.

BRIEF DESCRIPTION OF DRAWINGS

Examples will now be described, by way of non-limiting example, with reference to the accompanying drawings, in which.

DETAILED DESCRIPTION

A print apparatus may be used to deposit ink onto a substrate or print medium, such as a sheet of paper, in a pattern in accordance with a print instruction. In some printing systems, for example liquid electrophotography (LEP) printing systems, ink may be deposited onto a roller and transferred onto the print medium. In such example systems, the ink to be used may be a solution including a solvent, such as imaging oil (sometimes called base oil), and a solute, such as print agent.

Figure 1:
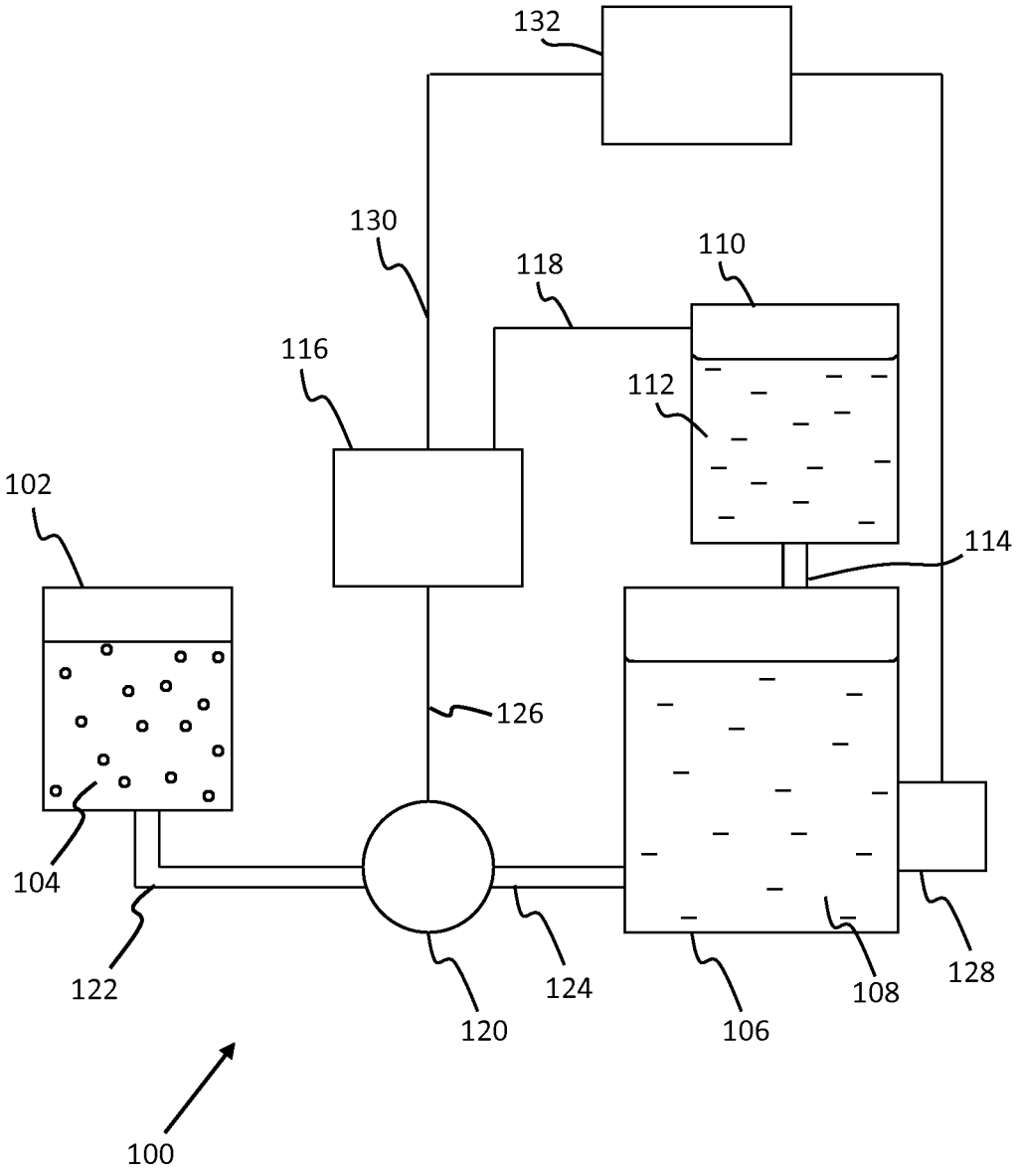
FIG. 1 is a simplified schematic of an example of a print apparatus.

FIG. 1 shows, schematically, components of an example print apparatus 100. The print apparatus 100 includes a print agent reservoir 102 to store print agent 104. The print agent reservoir 102 may, in some examples, be a canister, vessel, hopper or other container, such as a can or a tube, which contains the print agent 104 until the print agent is to be used. The print agent reservoir, or container 102, may be removable from the print apparatus 100, such that, when the container 102 becomes empty, a user or operator may remove the container from the print apparatus and replace it with a new, fuller container.

The print agent 104 may, in some examples, be a powder, a liquid or a gel. For example, the print agent 104 may be a solid powder material which may be stored in the container 102. In some examples, the print agent may be a solid ink, toner, or concentrated ink. The print apparatus 100 also includes a print solution reservoir 106 (such as container, vessel or tank), to store print solution 108. The print solution 108 may be a solution of print agent 104 dissolved into a solvent, such as an oil, for example imaging oil or base oil. In some examples, the print solution reservoir 106 may be in fluid communication with a solvent reservoir 110 for storing solvent 112. The solvent 112 may flow into the print solution reservoir 106 via a solvent conduit 114. The print apparatus 100 may further include a processing apparatus 116, such as a processor or control unit. The processing apparatus 116 may be connected to the solvent reservoir 110, for example by a control line 118, and may control the flow of imaging oil 112 into the print solution reservoir 106. For example, the processing apparatus 116 may cause imaging oil 112 to flow into the print solution reservoir 106 when an amount (e.g. a level) of print solution 108 in the print solution reservoir falls below a defined level.

The print apparatus 100 may further comprise a pump 120 (such as a gear pump or other transfer apparatus), which may be in fluid communication with the print agent reservoir 102 via a first pump conduit 122, and in fluid communication with the print solution reservoir 106 via a second pump conduit 124. The pump 120 may be controlled by the processing apparatus 116 via a pump control line 126.

According to some examples, a sensor 128 may associated with the print solution reservoir 106. The sensor 128 may be an optical density sensor (ODS). In some examples, the sensor 128 may be located within, on, near to, or remote from the print solution reservoir 106. The sensor may be associated with the print solution reservoir 106 such that a parameter of the print solution 108 within the reservoir 106 may be analysed by the sensor. The sensor 128 may, in some examples, be arranged to measure a concentration of print agent 104 within the print solution 108 in the print solution reservoir 106. The sensor 128 may be operated and/controlled by the processing apparatus 116, for example via a sensor control line 130.

The print apparatus may, in some examples, further comprise a sensor calibration system 132. The sensor calibration system 132 may be controlled by the processing apparatus 116. The sensor calibration system 132 may calibrate the sensor 128 in accordance with the methods described below. In some examples, the sensor calibration system 132 may form part of the processing apparatus 116

In some examples, the sensor 128 may comprise a pair of lenses, a light source and a light detector. Print solution 108 may pass between the two lenses (not shown) of the sensor, and light from the light source (not shown) of the sensor may be directed through lenses and through the print solution between the lenses. The light detector which, in some examples, may comprise a photodetector (not shown), may measure the amount of the light from the light source that passes through the lenses and the print solution. Some of the light may be absorbed by the print agent 104, and the amount of light absorbed may depend at least in part on the amount, or concentration, of print agent dissolved within the print solution 108. Thus, print solution 108 having a relatively higher concentration of print agent 104 dissolved therein may transmit a relatively smaller proportion of light than a print solution having a relatively lower concentration of print agent dissolved therein.

In operation, print solution 108 from the print solution reservoir 106 may be transferred to a printable medium, for example via a roller (not shown). As noted above, as the level of print solution 108 in the print solution reservoir 106 reduces, solvent 112 may be fed into the print solution reservoir. A particular intended colour of print solution 108 may be formed from particular proportions of print agent 104 and solvent 112. Thus, if solvent 112 is added to the print solution reservoir 106, print agent 104 may also be added to maintain the intended concentration (and therefore the intended colour). The sensor 128 may monitor the density of print agent 104 in the print solution 108, for example continuously or at intervals during use. A signal may be generated (for example by the processing apparatus 116) if the sensor 128 detects that the density of print agent 104 has fallen below a first defined threshold. In some examples, if the sensor 128 detects that the concentration of print agent 104 has fallen below a defined level, then the processing apparatus 116 may operate the pump 120 to pump print agent 104 from the print agent reservoir 102 into the print solution reservoir 108, to increase the concentration of print agent.

The printing system 100 may include a print solution reservoir 106 and an associated sensor 128 for each colour of ink to be printed. Due to slight differences in optical components in the sensors 128 and slight mechanical differences in components of the sensors, the sensors may measure densities slightly differently from one another. Thus, to achieve better consistency in the colour of ink to be printed by the printing system 100, each sensor may be calibrated before it is used to measure print agent concentrations.

According to examples described herein, an uncalibrated sensor (for example a newly manufactured sensor) may be calibrated against a first colour (for example black, also called "key" in printing), and a relationship relating measurements made with ink of a reference colour and ink of other colours may be determined and applied to data obtained using the sensor. In some examples, the reference colour may be the same as the first colour. The term "uncalibrated sensor" may include a sensor which has been previously calibrated and which is to be recalibrated. In other words, an uncalibrated sensor may include any sensor to be calibrated.

For each colour of ink to be used by the printing system 100, a relationship, or expression may be determined, which relates each colour to a particular standard, or reference colour. In examples disclosed herein, the reference colour may be black, or key. However, in other examples, a different, non-black colour may be used as the reference colour. The relationship between a particular colour and the black reference may be established, for example, when the particular colour of ink is to be created for the first time. Once the relationship has been established, it will remain unchanged, and may be applied to data consistently, as long as the particular colour remains the same (for example, maintains the same value in the Pantone® Matching System).

Various parameters affect the amount of light that is transmitted through a print solution 108 being analysed by the sensor 128. Some of the light emitted by the light source, $I_0$, may be absorbed, some of the light may be scattered and some of the light may be reflected. The amount of absorption, scattering and reflection may depend, at least in part, on the concentration of print agent 104 in the print solution 108. Based on the print agent concentration, the expected amount of light to be transmitted may be calculated using the Beer-Lambert law:

$$I_{meas}=I_0\exp^{-\varepsilon LX}, \quad [1]$$

where $I_{meas}$ is the expected amount (e.g. the intensity) of light to be transmitted and detected by the detector in the sensor 128; $I_0$ is the amount (e.g. the intensity) of light emitted by the light source of the sensor 128, ε is a light absorption coefficient of the print agent; L is a light absorption coefficient of the sensor 128 (so εL is the total light absorption coefficient); and X is the print agent concentration.

A generalization of the Beer-Lambert law can be written as:

$$I_{meas} = \exp^{[S_{eff}X^2+L_{eff}X+R_{eff}]}, \quad [2]$$

where $R_{eff}$ is the effective reflection coefficient, representing the amount of light reflected by the print agent 104; $S_{eff}$ is the effective scattering coefficient, representing the amount of light scattered by the print agent; and $L_{eff}$ is the effective absorption coefficient, representing the amount of light absorbed by the print agent.

Expression [2] may be rearranged for X, such that the print agent concentration may be given by:

$$X = \frac{1}{2S_{eff}}\left(-L_{eff} - \sqrt{L_{eff}^2 - 4S_{eff}(R_{eff} - \ln[I_{meas}])}\right). \quad [3]$$

Figure 2:
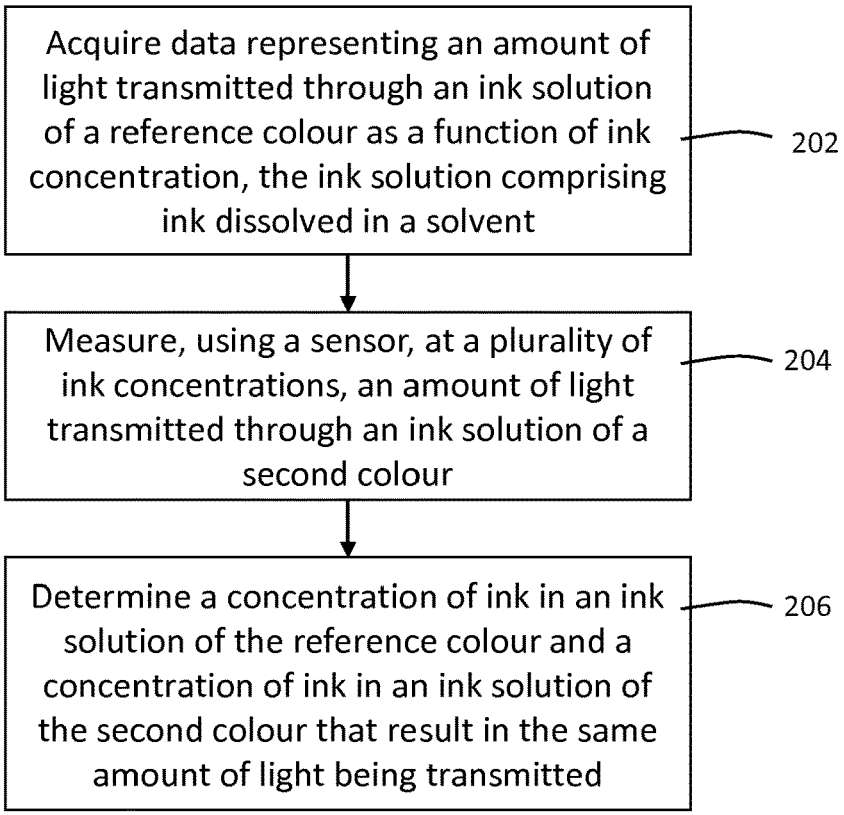
FIG. 2 is a flowchart of an example method of obtaining sensor calibration data.

FIG. 2 is a flowchart of an example method for calibrating a sensor, such as an uncalibrated sensor. The method described with reference to FIG. 2 may be used to obtain sensor calibration data, or colour calibration data, which may be used to generate an expression relating a particular colour to a reference colour, such as black. As noted above, such a method may be performed when ink of a new colour is created, for example in a laboratory. The method comprises, at block 202, acquiring data representing an amount of light transmitted through an ink solution of a reference colour as a function of ink concentration, the ink solution comprising ink dissolved in a solvent. The reference colour may, in some examples, be black. The data may, in some examples, be obtained using a sensor, such as an optical density sensor. In some examples, the data may be obtained by measuring, at a plurality of ink concentrations, an amount of light transmitted through an ink solution of the reference colour. For example, a first measurement may be taken of the amount of light transmitted through pure solvent (i.e. solvent, such as imaging oil, having no ink, or print agent, dissolved therein; in other word, the print agent concentration may be 0% NVS (percentage of non-volatile solids)). An amount of ink of the reference colour may be then be added to form a print solution (e.g. having an ink concentration of 0.1% NVS), and a second measurement may be taken of the amount of light transmitted through the solution. More ink of the reference colour may be added such that the print solution has an ink concentration of, for example, 0.2% NVS and a third measurement may be taken. Additional measurements may be taken at various ink concentrations. In some examples, data obtained by performing light transmission measurements at various ink concentrations may be used to generate an expression relating light transmission with ink concentration. In some examples, the expression may be represented by a curve.

At block 204, the method may comprise measuring, using a sensor, at a plurality of ink concentrations, an amount of light transmitted through an ink solution of a second colour. The measuring (block 204) may be performed using a method similar to the method discussed above with reference to block 202. The second colour may be any colour other than black, such as, for example, cyan, magenta, yellow, light cyan or light magenta.

By applying the data acquired by said acquiring (block 202) and data measured by said measuring (block 204) to equation [2] above, in an example where the reference colour is black and the second colour is yellow, two further equations may be obtained:

$$I_{meas_K} = \exp^{[S_K X_K^2 + L_K X_K + R_K]} \quad [4]$$

and $$I_{meas_Y} = \exp^{[S_Y X_Y^2 + L_Y X_Y + R_Y]}, \quad [5]$$

where $I_{meas_K}$ and $I_{meas_Y}$ are the expected amounts of light to be detected by the detector in the sensor for the reference colour, black (K), and the second colour, yellow (Y), respectively, $S_K$, $L_K$ and $R_K$ are the scattering, absorption and reflection coefficients for black ink, respectively, and $X_K$ is the ink concentration of black ink, $S_Y$, $L_Y$ and $R_Y$ are the scattering, absorption and reflection coefficients for yellow ink, respectively, and $X_Y$ is the ink concentration of yellow ink.

The method may comprise at block 206, determining, using a processor, a concentration of ink in an ink solution of the reference colour and a concentration of ink in an ink solution of the second colour that allow the same amount of light to be transmitted. In other words, the processor may calculate the ink concentrations of the ink solutions of the reference colour and the second colour that result in the same amount of light transmission. For example, for black ink, an ink solution having an ink concentration of 0.5% NVS may allow 30% of the input light to be transmitted through the solution and detected. For the second colour (e.g. yellow), it may be calculated from the measurements (block 204) that the same amount of light transmission (i.e. 30% of the input light) may result from an ink solution having an ink concentration of 3% NVS. The determining (block 206) may be repeated for a plurality of values of light transmission over a range of light transmission. For example the determining (block 206) may include determining concentrations of ink of the reference colour and the second colour that give rise to the same amount of light transmission over a range of values of light transmission.

The determining (block 206) may, in some examples, be performed using the equations [4] and [5] above. From equations [4] and [5], a translation function may be calculated relating the concentrations of ink of the reference colour (e.g. black) and the second colour (e.g. yellow):

$$X_K = A_Y X_Y^2 + B_Y X_Y + C_Y, \quad [6]$$

where $A_Y$, $B_Y$ and $C_Y$, are constants.

Thus, the method may, in some examples, comprise determining, using a processor, a translation function relating the concentration of ink in the ink solution of the reference colour and the concentration of ink in the ink solution of the second colour, over a range of ink concentrations.

Figure 3:
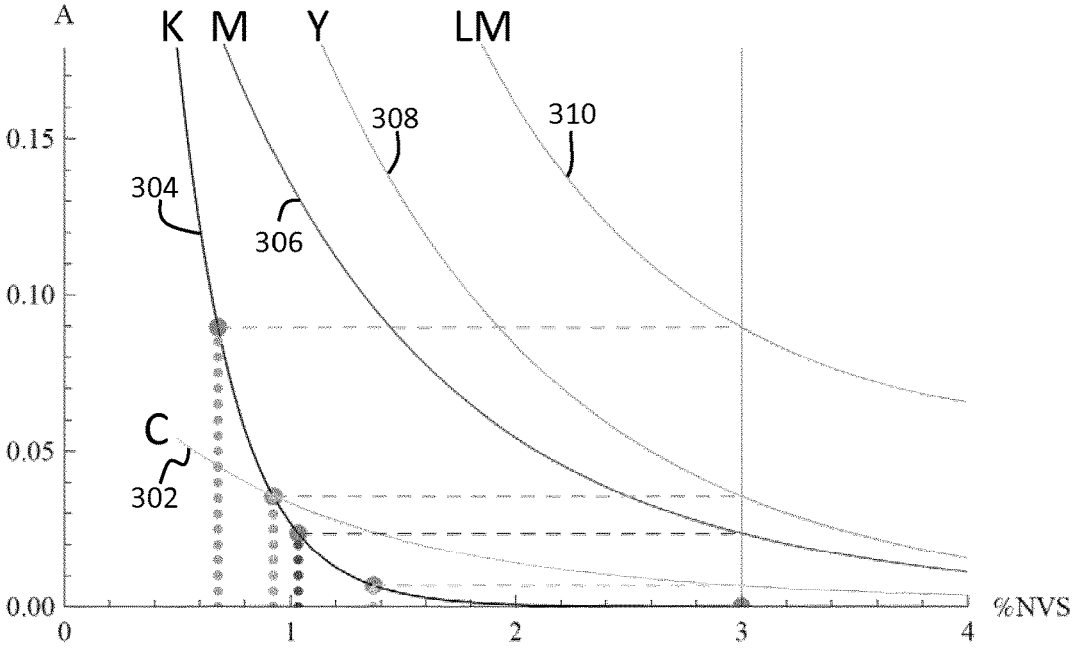
FIG. 3 is a graph showing curves of light transmission as a function of ink concentration for inks of various colours.

A graph showing example curves representative of light transmission as a function of ink concentration for various colours is shown in FIG. 3. In the graph of FIG. 3, the y-axis, labelled "A", represents light transmission. In this example, the light transmission is measured in Amperes (i.e. a current proportional to the amount of light received at the detector). In other examples, the light transmission may be measured as an intensity of the light received at a detector. The x-axis in FIG. 3 represents ink concentration in % NVS (percentage of non-volatile solids). Five curves are shown in FIG. 3. A first curve 302 represents cyan (C) ink; a second curve 304 represents black, or key (K), ink; a third curve 306 represents magenta (M) ink; a fourth curve 308 represents yellow (Y) ink; and a fifth curve 310 represents light magenta (LM) ink. From the first curve 302 in FIG. 3, it can be deduced that, for cyan ink, a light transmission of approximately 0.01 may be achieved with an ink concentration of around 3% NVS, and a similar light transmission may be achieved with an ink concentration of around 1.4% NVS using black ink. From the third curve 306, it can be deduced that, for magenta ink, a light transmission of approximately 0.025 may be achieved with an ink concentration of around 3% NVS, and a similar light transmission may be achieved with an ink concentration of around 1% NVS using black ink. From the fourth curve 308, it can be deduced that, for yellow ink, a light transmission of approximately 0.035 may be achieved with an ink concentration of around 3% NVS, and a similar light transmission may be achieved with an ink concentration of around 0.9% NVS using black ink. From the fifth curve 310, it can be deduced that, for light magenta ink, a light transmission of approximately 0.9 may be achieved with an ink concentration of around 3% NVS, and a similar light transmission may be achieved with an ink concentration of around 0.7% NVS using black ink.

Thus, a calibration factor may be established for each colour, relating each colour and a reference colour (e.g. black) for a particular value of light transmission. By considering the corresponding ink concentrations for inks of different colours at a number of different light transmission values, or over a range of light transmission values, it may be possible to determine a calibration factor for each light transmission value, or a calibration relationship relating the ink concentrations over the range of light transmission values.

As can be seen from the second curve 304 in the graph of FIG. 3, the light transmission through black ink varies relatively greatly over a relatively small change in ink concentration, compared to other colours. Therefore, using black ink, relatively accurate readings may be taken by making small changes to the ink concentration.

Figure 4:
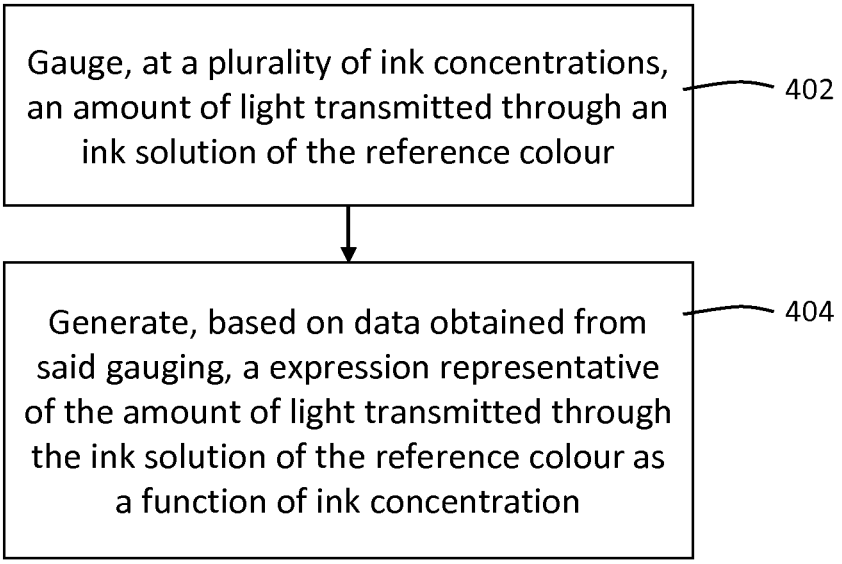
FIG. 4 is a flowchart of an example method of obtaining sensor calibration data.

FIG. 4 is a flowchart of an example method of obtaining calibration data. The acquiring of block 202 (FIG. 2) may comprise, at block 402, gauging, using a sensor, at a plurality of ink concentrations, an amount of light transmitted through an ink solution of the reference colour. In some examples, the method may comprise, at block 404, generating, based on data obtained from said gauging, an expression representative of the amount of light transmitted through the ink solution of the reference colour as a function of ink concentration. In some examples, the generated expression may comprise a curve (for example the curve 304 of FIG. 3).

Figure 5:
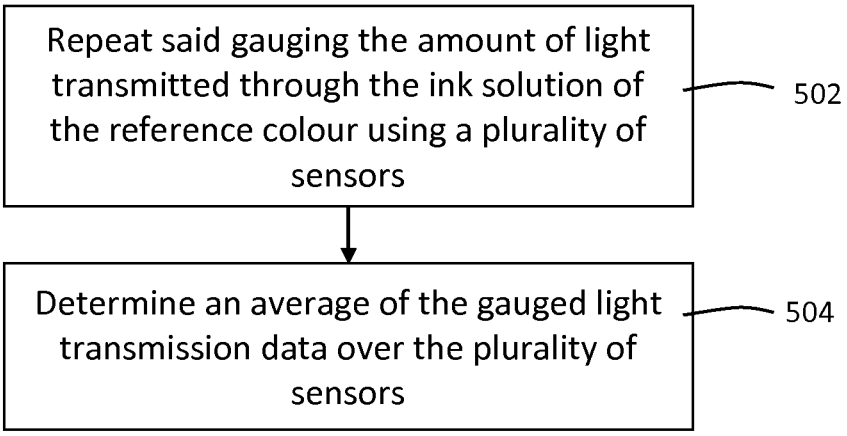
FIG. 5 is a flowchart of an example method of obtaining sensor calibration data.

FIG. 5 is a flowchart of an example method of obtaining calibration data. In block 502, the method may comprise repeating said gauging the amount of light transmitted through the ink solution of the reference colour using a plurality of sensors. The method may further comprise, at block 504, determining an average of the gauged light transmission data over the plurality of sensors. In some examples, a plurality of sensors may be used to measure light transmission through an ink solution of the reference colour at the same plurality of ink concentrations. In this way, a spurious reading from a sensor (for example, a faulty sensor) may have less of an effect on the result of the measurements and, therefore, the data relating to the light transmission through ink of the reference colour may be more accurate.

Figure 6:
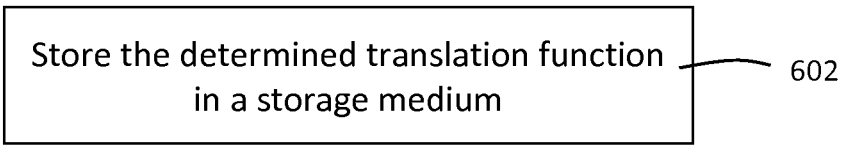
FIG. 6 is a flowchart of an example method of obtaining sensor calibration data.

As noted above, once a relationship between the light transmission through an ink solution of the reference colour and an ink solution of the second colour has been determined, the relationship may remain constant for those two colours. Thus, data relating to the relationship (such as the translation function) may be stored and used for calibrating other sensors. FIG. 6 is a block of a flowchart of an example method of obtaining calibration data. The method may comprise, at block 602, storing said determined translation function in a storage medium. In some examples, the storage medium may be a memory device associated with processing apparatus of the print apparatus. The storage medium may be portable such that it can be connected to a printing apparatus and used in calibrating a sensor of the printing apparatus. The stored data may, in some examples, comprise an expression defining the relationship, a database, a correspondence table, or lookup table containing measured data. For example, the stored data may comprise a table containing light transmission data for ink solutions of the reference colour and the second colour over a range of ink concentrations.

While the discussion above describes obtaining data relating to an ink solution of the second colour (and its correspondence to an ink solution of the reference colour, such as black), data may be obtained which relates to in solutions of other colours, and their correspondence to the reference colour. The data relating to various colours may, in some examples, be stored in the storage medium.

The discussion above, with reference to FIGS. 4 to 6, relates to a method for obtaining calibration data which relates light transmission data for an ink solution of a particular colour to corresponding light transmission data for an ink solution of a reference colour, such as black. The obtained calibration data may be used to calibrate an uncalibrated sensor, such as a sensor to be installed in a printing apparatus. In some examples, a tank for containing ink solution of a particular colour may be installed in a printing apparatus. The tank may include an uncalibrated sensor. In some examples, it may be intended that the uncalibrated tank be calibrated prior to its use in a printing operation. Calibrating a sensor to be used in a printing apparatus may improve colour consistency with other sensors, such that the printed colour of a print solution of a particular colour to be printed by the printing apparatus appears consistent. The calibration of a sensor may be performed, for example, when the sensor is new, before the sensor is installed in a printing system.

Figure 7:
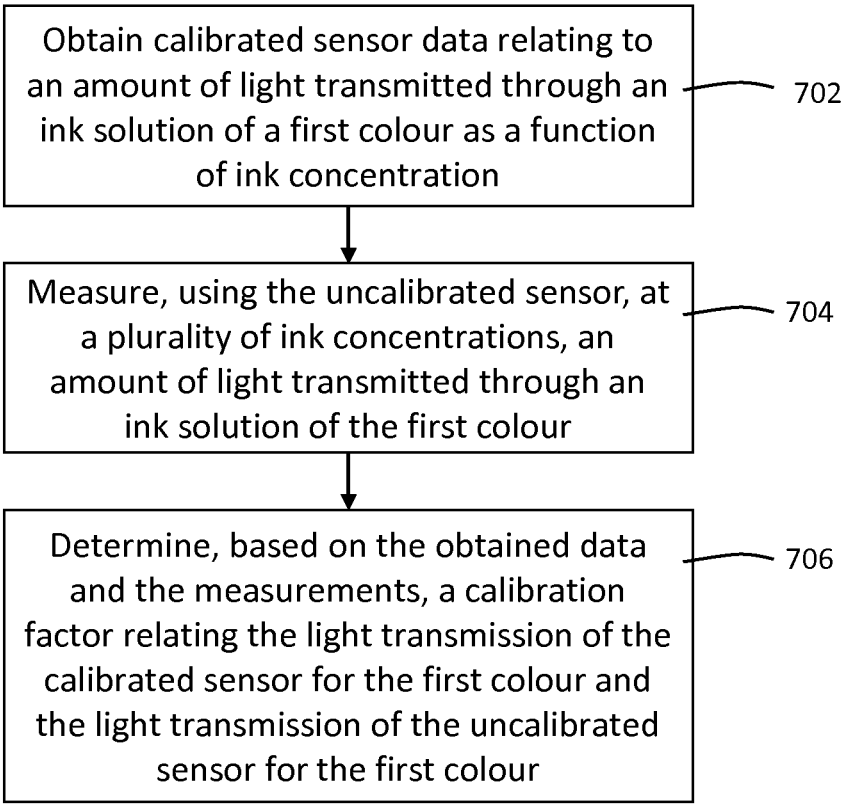
FIG. 7 is a flowchart of an example method of calibrating a sensor.

FIG. 7 is a flowchart of an example method for calibrating a sensor, such as an uncalibrated sensor. The method comprises, at block 702, obtaining calibrated sensor data, the data relating to an amount of light transmitted through an ink solution of a first colour as a function of ink concentration. In some examples, the first colour may be black. The data obtained at block 702 may, in some examples, be the same as the data obtained at block 202 of FIG. 2. In other words, once an accurate set of reference data has been obtained (for example for black ink), it may be used to calibrate uncalibrated sensors.

The method may comprise, at block 704, measuring, using the uncalibrated sensor, at a plurality of ink concentrations, an amount of light transmitted through an ink solution of the first colour. The measuring of block 704 may comprise repeating the method (such as the method described with reference to block 202 of FIG. 2) used to obtain data for the calibrated sensor, using the uncalibrated sensor rather than a calibrated sensor.

At block 706, the method may comprise determining, using a processor, based on the obtained data (e.g. from block 702) and the measurements (e.g. from block 704), a calibration factor relating the light transmission of the calibrated sensor for the first colour and the light transmission of the uncalibrated sensor for the first colour. In some examples, the differences (if any) between measurements made by a calibrated sensor and an uncalibrated sensor may be linear. In other words, the difference between the measurements may be constant for any ink concentration. Thus, the determined calibration factor may be a multiplication factor to be applied to any measurement made by the uncalibrated sensor in order to take account, for example, of mechanical differences in components of the sensor.

In some examples, the uncalibrated sensor may be a sensor which has been previously calibrated but is to be re-calibrated.

Figure 8:
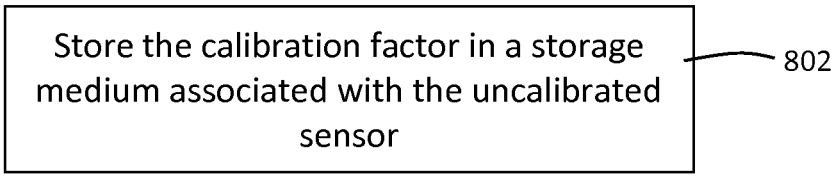
FIG. 8 is a flowchart of an example method of calibrating a sensor.

FIG. 8 is a flowchart of an example method of calibrating a sensor. In block 802, the method may comprise storing the calibration factor in a storage medium associated with the uncalibrated sensor. In some examples, the method may apply the calibration factor to data acquired using the uncalibrated sensor. For example, as the uncalibrated sensor takes measurements, a processing apparatus associated with the uncalibrated sensor and/or with the printing apparatus may apply the calibration factor to the measurements to take account of mechanical differences between the sensors.

Figure 9:
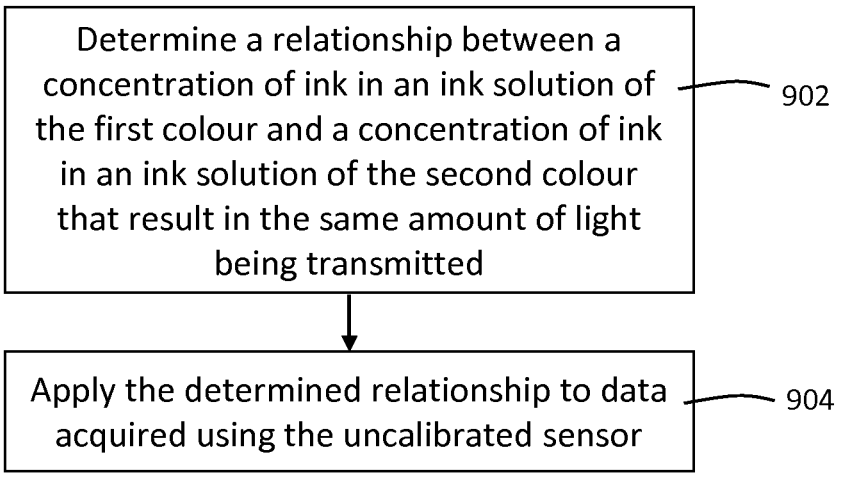
FIG. 9 is a flowchart of an example method of calibrating a sensor.

FIG. 9 is a flowchart of an example method of calibrating a sensor. The method may comprise, at block 902, determining a relationship between a concentration of ink in an ink solution of the first colour and a concentration of ink in an ink solution of the second colour that result in the same amount of light being transmitted. The determination made in block 902 may be the same as, or similar to the determination made in block 206 of FIG. 2. In block 904, the method may comprise applying the determined relationship to data acquired using the uncalibrated sensor. In other words, once the uncalibrated sensor is corrected (e.g. using the determined calibration factor) for the first colour (e.g. the reference colour, black), a relationship between the first (reference) colour and other colours may be established. As noted above, the relationships between the reference colour and other colours may be expressed, in some examples, as expressions, or as data in databases or lookup tables. The relationships may be accessed by a processing apparatus associated with the uncalibrated sensor such that measurements made by the uncalibrated sensor may be adjusted accurately, giving accurate readings for any colour for which calibration data has been determined. In this way, an uncalibrated sensor may be calibrated against the first colour (e.g. the reference colour, such as black), for example using the process discussed with reference to FIG. 2. The colour reference data relating each ink colour to the reference colour may then be applied to measurements made by the uncalibrated sensor to obtain accurate measurements. Therefore, rather than calibrating a sensor against ink of every colour that might be used (which may involve repeating the process discussed with reference to FIG. 2 for each colour), a sensor may be calibrated against only a single reference colour (e.g. black), and a relationship between other colours and that reference colour may be used to obtain accurate and consistent measurements for multiple colours. The methods disclosed herein, therefore, may reduce the amount of time spent calibrating sensors.

The relationship determined at block 902 may, in some examples, be applied to data by a processor. The translation function in equation [6] above may be used to determine the concentration of ink of a second colour (e.g. yellow) from a particular measured light transmission value using a sensor which has been calibrated only for a first, reference colour (e.g. black).

Substituting the translation function of equation [6] into the equation [2] gives:

$$I_{meas} = \exp^{[S_{eff}(A_Y X_Y^2 + B_Y X_Y + C_Y)^2 + L_{eff}(A_Y X_Y^2 + B_Y X_Y + C_Y) + R_{eff})} \quad [7]$$

By substituting measured values of $X_Y$ and $I_{meas}$ into equation [7], it is possible to calibration parameters $S_{eff}$, $L_{eff}$ and $R_{eff}$ for yellow ink. Substituting values for the calibration parameters into equation [3] above provides the actual concentration of yellow ink that results in any measured value of light transmission, $I_{meas}$.

Figure 10:
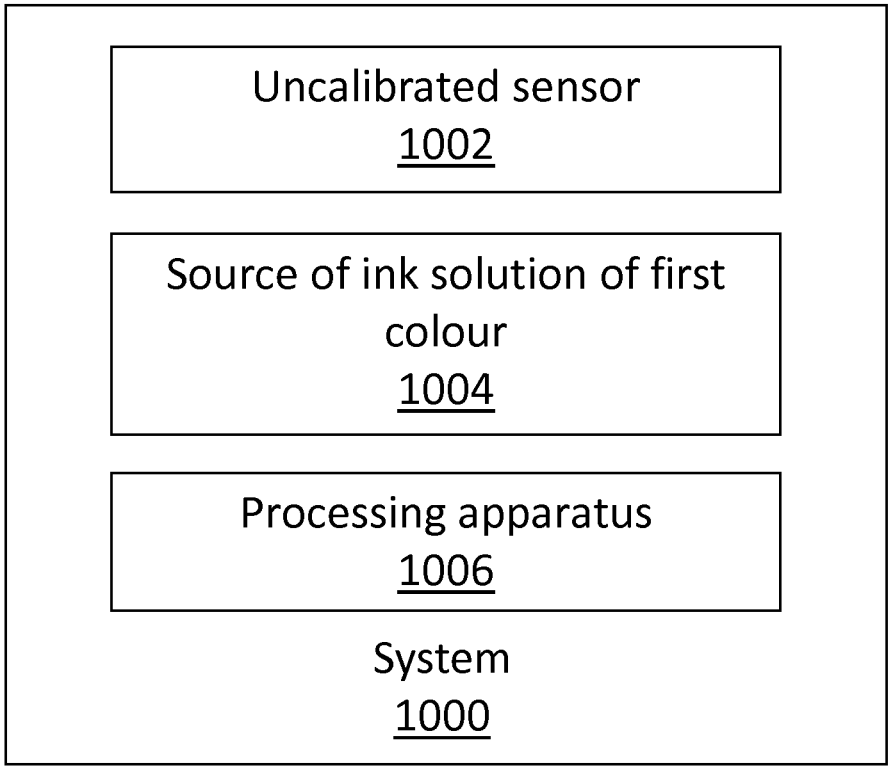
FIG. 10 is a schematic of an example of a system for calibrating a sensor.

A schematic of an example of a system for calibrating a sensor is shown in FIG. 10. FIG. 10 shows a system 1000 an uncalibrated sensor 1002. The sensor 1002 may, in some examples, a sensor for use in a printing system. In some examples, the sensor may comprise an optical density sensor. The system 1000 may comprise a source of ink solution of a first colour, the ink solution of the first colour comprising concentrated ink of the first colour dissolved in a solvent. In some examples, the sensor 1002 may be a sensor to be used in an ink solution tank, and may be used to monitor the density of concentrated in the ink solution. The system 1000 may comprise processing apparatus 1006. The processing apparatus may receive calibrated sensor data indicative of light transmission through an ink solution of a first colour as a function of ink concentration. The received calibrated sensor data may, in some examples, be data as may be obtained in the process of block 202 of FIG. 2. The processing apparatus 1006 may measure, using the uncalibrated sensor 1002, at a plurality of ink concentrations, light transmission through an ink solution of the first colour. In some examples, the processing apparatus 1006 may determine, based on the received data and the measurements, a calibration factor relating the light transmission of the calibrated sensor for the first colour and the light transmission of the uncalibrated sensor for the first colour.

In some examples, the system 1000 may comprise a printing system. Thus, the application of the calibration factor may take place while the uncalibrated sensor 1002 is installed in or on a printing apparatus.

Figure 11:
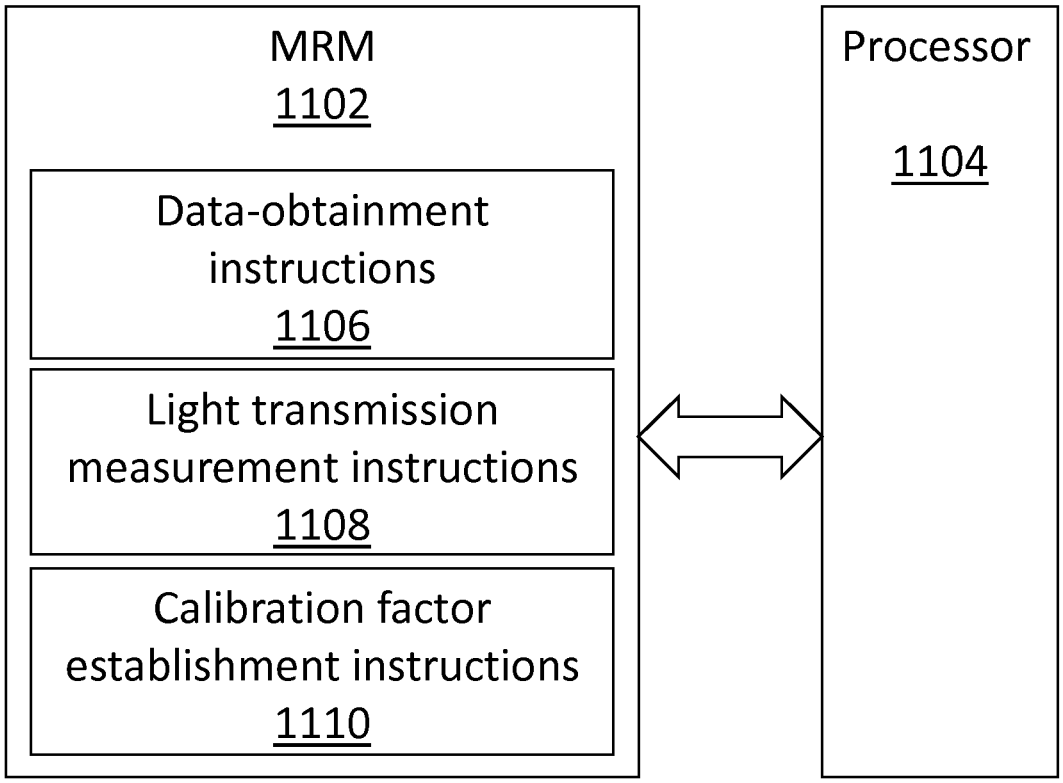
FIG. 11 is a schematic of an example machine readable medium with a processor.

FIG. 11 is a schematic of an example machine readable medium 1102 with a processor 1104. The machine-readable medium 1102 may comprise data-obtainment instructions 1106 which, when executed by a processor 1104, cause the processor to obtain data indicative of light transmission through an print agent solution of a first colour as a function of print agent concentration, the data relating to a calibrated sensor. The machine-readable medium 1102 may further comprise light transmission measurement instructions 1108 which, when executed by a processor 1104, cause the processor to measure, using an uncalibrated sensor, at a plurality of print agent concentrations, light transmission through a print agent solution of the first colour. The machine-readable medium 1102 may further comprise calibration factor establishment instructions 1110 which, when executed by a processor 1104, cause the processor to establish, using processing apparatus, based on the obtained data and the measurements, a calibration factor between the obtained light transmission data of the calibrated sensor for the first colour and measured light transmission data of the uncalibrated sensor for the first colour. The calibration factor may, in some examples, be established using the processor 1104.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method for calibrating an uncalibrated sensor, the method comprising:

obtaining calibrated sensor data measured at a calibrated sensor, the data relating to an amount of light transmitted through an ink solution of a first colour as a function of ink concentration;

measuring, using the uncalibrated sensor, at a plurality of ink concentrations, an amount of light transmitted through an ink solution of the first colour;

determining, using a processor, based on the obtained data and the measurements, a calibration factor relating the light transmission of the calibrated sensor for the first colour and the light transmission of the uncalibrated sensor for the first colour; and determining, using the same processor or a different processor, a relationship between a concentration of ink in an ink solution of the first colour and a concentration of ink in an ink solution of a second colour that result in the same amount of light being transmitted.

2. A method according to claim 1, further comprising:

storing the calibration factor in a storage medium associated with the uncalibrated sensor.

3. A method according to claim 1, further comprising:

applying the calibration factor to data acquired using the uncalibrated sensor.

4. A method according to claim 1, further comprising:

applying the determined relationship to data acquired using the uncalibrated sensor.

5. A method according to claim 1, wherein the first colour is black.

6. A method according to claim 1, comprising, prior to said obtaining calibrated sensor data:

acquiring data representing an amount of light transmitted through an ink solution of the first colour as a function of ink concentration, the ink solution comprising ink dissolved in a solvent;

measuring, using a sensor, at a plurality of ink concentrations, an amount of light transmitted through an ink solution of the second colour;

determining, using a processor, the concentration of ink in an ink solution of the first colour and the concentration of ink in an ink solution of the second colour that result in the same amount of light being transmitted.

7. A method according to claim 6, wherein said acquiring comprises:

gauging, using a sensor, at a plurality of ink concentrations, an amount of light transmitted through an ink solution of the first colour; and generating, based on data obtained from said gauging, an expression representative of the amount of light transmitted through the ink solution of the first colour as a function of ink concentration.

8. A method according to claim 7, where said obtaining further comprises:

repeating said gauging the amount of light transmitted through the ink solution of the first colour using a plurality of sensors; and determining an average of the gauged light transmission data over the plurality of sensors.

9. A method according to claim 6, further comprising:

determining, using a processor, a translation function relating the concentration of ink in the ink solution of the first colour and the concentration of ink in the ink solution of the second colour, over a range of ink concentrations.

10. A method according to claim 9, further comprising:

storing said determined translation function in a storage medium.

11. A system for calibrating an uncalibrated sensor, the system comprising:

an uncalibrated sensor;

a source of ink solution of a first colour, the ink solution of the first colour comprising concentrated ink of the first colour dissolved in a solvent; and processing apparatus to:

receive calibrated sensor data measured at a calibrated sensor indicative of light transmission through an ink solution of a first colour as a function of ink concentration;

measure, using the uncalibrated sensor, at a plurality of ink concentrations, light transmission through an ink solution of the first colour;

determine, based on the received data and the measurements, a calibration factor relating the light transmission of the calibrated sensor for the first colour and the light transmission of the uncalibrated sensor for the first colour; and determine a relationship between a concentration of ink in the ink solution of the first colour and a concentration of ink in an ink solution of a second colour that result in the same amount of light being transmitted.

12. A system according to claim 11, wherein the sensor comprises a sensor for use in a printing system.

13. A system according to claim 11, wherein the sensor comprises an optical density sensor.

14. A machine-readable medium comprising instructions which, when executed by a processor, cause the processor to:

obtain data indicative of light transmission through an print agent solution of a first colour as a function of print agent concentration, the data relating to a calibrated sensor;

measure, using an uncalibrated sensor, at a plurality of print agent concentrations, light transmission through a print agent solution of the first colour;

establish, using the processor, based on the obtained data and the measurements, a calibration factor between the obtained light transmission data of the calibrated sensor for the first colour and measured light transmission data of the uncalibrated sensor for the first colour; and establish, using the processor, a relationship between a concentration of print agent in the print agent solution of the first colour and a concentration of print agent in a print agent solution of a second colour that result in the same amount of light being transmitted.

* * * * *